US005965205A

United States Patent [19]

Yoshida

[11] Patent Number: 5,965,205

[45] Date of Patent: Oct. 12, 1999

[54] COMPOSITION AND PROCESS FOR TREATING TINNED SURFACES

[75] Inventor: Masayuki Yoshida, Kanagawa-Ken, Japan

[73] Assignee: Henkel Corporation, Gulph Mills, Pa.

[21] Appl. No.: 09/000,006

[22] PCT Filed: Jul. 19, 1996

[86] PCT No.: PCT/US96/11535

§ 371 Date: Jan. 21, 1998

§ 102(e) Date: Jan. 21, 1998

[87] PCT Pub. No.: WO97/04144

PCT Pub. Date: Feb. 6, 1997

[30] Foreign Application Priority Data

Jul. 21, 1995 [JP] Japan ..... 7-185420

[51] Int. Cl.[6] ..... B05D 3/00; B05D 3/02; C23C 22/23

[52] U.S. Cl. ..... 427/354; 148/251; 148/259; 427/388.4; 427/435

[58] Field of Search ..... 148/251, 259; 427/354, 388.4, 435

[56] References Cited

U.S. PATENT DOCUMENTS

| | | | |
|---|---|---|---|
| 4,332,646 | 6/1982 | Tsurumaru et al. | 204/1 T |
| 4,714,752 | 12/1987 | Sokalski | 528/153 |
| 4,859,351 | 8/1989 | Awad | 252/32.5 |
| 4,927,472 | 5/1990 | Matsushima et al. | 148/261 |
| 4,963,596 | 10/1990 | Lindert et al. | 526/313 |
| 4,970,264 | 11/1990 | Lindert et al. | 525/328.8 |
| 5,039,770 | 8/1991 | Lindert et al. | 526/312 |
| 5,063,089 | 11/1991 | Lindeert et al. | 427/354 |
| 5,068,299 | 11/1991 | Lindert et al. | 526/313 |
| 5,116,912 | 5/1992 | Lindert et al. | 525/340 |
| 5,246,507 | 9/1993 | Kodama et al. | 148/250 |
| 5,266,410 | 11/1993 | Lindert et al. | 428/461 |
| 5,356,491 | 10/1994 | Aoki et al. | 148/253 |
| 5,498,300 | 3/1996 | Aoki et al. | 148/261 |

FOREIGN PATENT DOCUMENTS

| | | |
|---|---|---|
| 61-091369 | 5/1986 | Japan . |
| 1 085292 | 3/1989 | Japan . |
| 1 100281 | 4/1989 | Japan . |
| 1 172406 | 7/1989 | Japan . |
| 1 177379 | 7/1989 | Japan . |
| 1 177380 | 7/1989 | Japan . |
| 2 000608 | 1/1990 | Japan . |
| 2 000609 | 1/1990 | Japan . |
| 4 187782 | 7/1992 | Japan . |
| 6 173024 | 6/1994 | Japan . |

*Primary Examiner*—Michael Lusignan
*Attorney, Agent, or Firm*—Ernest G. Szoke; Wayne C. Jaeschke; Norvell E. Wisdom, Jr.

[57] ABSTRACT

This invention relates to a process comprising the steps of contacting a metal surface with an aqueous composition comprising water and specific amounts by weight of phosphate ions, condensed phosphate ions and water soluble polymer molecules of a specific general formula, separating the contacted metal surface from the aqueous composition, rinsing with water and heating.

20 Claims, No Drawings

COMPOSITION AND PROCESS FOR TREATING TINNED SURFACES

TECHNICAL FIELD

This invention concerns novel waterbased compositions and methods for surface treatment of metallic surfaces that are predominantly tin and may be briefly denoted hereinafter simply as "tinned", particularly the surfaces of tin-plated drawn-and-ironed (hereinafter usually abbreviated "DI") cans which have been formed by subjecting tin-plated steel sheet to drawing and ironing. Compositions and methods of the invention also impart to the surfaces of such cans a low coefficient of surface friction, often referred to hereinafter simply as "-mobility", which is required for smooth and efficient mechanical conveying of the cans in high speed processing equipment in plants where such cans are lacquered, printed, and/or otherwise decorated on their surfaces.

BACKGROUND ART

Many liquid compositions, any of which hereinafter may be called "baths" for brevity, even though they may be used by spraying or other methods of establishing contact than immersion, are known for the purpose of treating tinned surfaces. The liquids disclosed, for example, in Japanese Patent Kokai H1-100281 are known as surface treatment liquids for tin-plated DI cans. These surface treatment liquids are chemical film forming liquids for the treatment of metal surfaces which contain from 1 to 50 grams/liter (hereinafter usually abbreviated as "g/L") of phosphate ions, from 0.2 to 20.0 g/L of oxyacid ions, from 0.01 to 5.0 g/L of tin ions and from 0.01 to 5.0 g/L of condensed phosphate ions, and in which the pH is from 2 to 6. Furthermore, surface treatment agents which have further improved surface treatment operability have been disclosed in Japanese Patent Kokai H6-173024. It is possible by treating tin-plated DI cans with these conventional chemical treatment agents to form a phosphate film which has excellent corrosion resistance of the surface of the tin-plated DI cans. However, there is a problem in that no improvement of mobility is observed with these phosphate based films. Furthermore, there has been a trend in recent years to reduce the amount of tin-plating on tin-plated DI cans, for reasons of economy, and surface treatment which has much better corrosion resistance than in the past is required for such lightly tin-plated DI cans.

On the other hand, if the outer surface of the cans has a high friction coefficient, in the can production process, slip failure between can surfaces may occur during the conveyor transportation of a large number of metal cans, so that the cans move sideways, and this leads to problems with transportation. The transportability of the cans is a particular problem when the cans are being moved into a printer. Hence, it is necessary to reduce the friction coefficient of the outer surface of the cans without having an adverse effect on the adhesion properties of the paint, printing ink(s) or lacquer which is to be coated on the outer surface of the can. The method disclosed in Japanese Patent Kokai S64-85292, for example, is known as a means of improving the mobility. A surface treatment agent for metal cans which contains water soluble organic materials selected from among phosphate esters, alcohols, mono- or poly-basic fatty acids, fatty acid derivatives and mixtures of these materials is used in this method. However, although an improvement in the mobility is achieved by this method, there is a problem in that there is often inadequate improvement in corrosion resistance and/or paint adhesion properties.

Furthermore, the methods disclosed in Japanese Patent Kokai S61-91369, Japanese Patent Kokai H1-172406, Japanese Patent Kokai HI-177379, Japanese Patent Kokai H1-177380, Japanese Patent Kokai H2-608 and Japanese Patent Kokai H2-609, for example, are known as methods for the surface treatment of metals in which water soluble polymers are used, with a view to providing the metal surface with corrosion resistance and adhesive properties. With these conventional methods the metal surface is treated with a solution which contains derivatives of polyhydric phenol compounds. However, with these conventional methods it is difficult to form a film which has adequate stability on the metal surface, so that satisfactory corrosion resistance often is not obtained. Also, there is still a problem in that satisfactory paint adhesion is not always obtained even with the method of treatment disclosed in Japanese Patent Kokai H4-187782 which is an improved method of treatment which includes the above-mentioned derivatives of polyhydric phenol compounds.

DISCLOSURE OF THE INVENTION

Problems to Be Solved by the Invention

The present invention is intended to provide predominantly tin metal surfaces with protective films which have excellent corrosion resistance and paint adhesion properties and which also provide excellent mobility, to resolve the problems of the prior art as outlined above.

Summary of the Invention

It has been discovered that films which have excellent corrosion resistance and paint adhesion properties, and which also have markedly improved—mobility, can be formed on tin-plated DI cans by bringing a surface treatment bath which contains specified amounts of phosphate ions, condensed phosphate ions and water soluble polymer of a specified structure and which has been adjusted to a pH of 6.0 or below into contact with the tin-plated DI can surfaces, and then rinsing the treated surfaces with water and drying by heating. The invention is based upon this discovery.

Details of the Invention, Including Preferred Embodiments Thereof

A composition according to the present invention for treating the surface of tinned metal characteristically comprises, preferably consists essentially of, or more preferably consists of, water and, in parts by weight:

(A) from 0.5 to 30 parts of orthophosphate ions (hereinafter usually denoted simply as "phosphate ions", except when it is necessary to differentiate them from condensed phosphate ions);

(B) from 0.1 to 10 parts of condensed phosphate ions; and (C) from 0.1 to 20 parts of water-soluble polymer conforming with the following general formula (I):

(I)

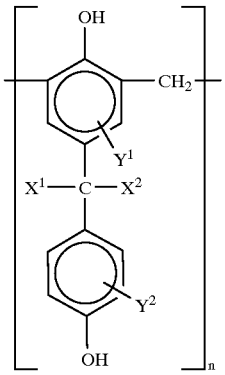

in which each of $X^1$ and $X^2$ independently of each other and independently from one unit of the polymer, said unit being defined as represented by a modification of formula (I) above in which the square brackets and the subscript n are omitted, to another unit of the polymer represents a hydrogen atom, a $C_1$ to $C_5$ alkyl group, or a $C_1$ to $C_5$ hydroxyalkyl group; each of $Y^1$ and $Y^2$ independently of one another and independently for each unit of the polymer represents a hydrogen atom or a moiety "Z" which conforms to one of the following formulas (II) and (III):

(II)

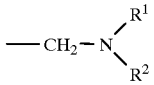

(III)

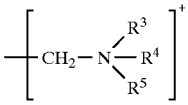

wherein each of $R^1$, $R^2$, $R^3$, $R^4$, and $R^5$ in formulas (II) and (III) independently represents a $C_1$ to $C_{10}$ alkyl group or a $C_1$ to $C_{10}$ hydroxyalkyl group; the moiety Z bonded to any single aromatic ring in the polymer molecule may be identical to or may differ from the moiety Z bonded to any other phenyl ring in the polymer molecule; and n represents a positive integer. In component (C) as a whole, the average value for the number of Z moieties substituted on each phenyl ring in the polymer molecule, which may be referred to hereinafter as "the average value for Z moiety substitution", is from 0.2 to 1.0; and the average value of n, which may be referred to hereinafter as "the average degree of polymerization", is from 2 to 50.

Compositions according to the invention as described above may be either working compositions, suitable for directly treating tinned metal substrates, or they may be concentrate compositions, which are useful for preparing working compositions, usually by dilution of the concentrate compositions with water, and optionally, adjustment of the pH of the resulting working composition. In a working composition, the total parts by weight of the composition preferably is 1000, when the three necessary ingredients other than water in the composition are present in parts by weight as already specified above. For concentrates, the total number of parts by weight will normally be considerably less than 1000, in particular preferably, primarily for reasons of economy, not more than, with increasing preference in the order given, 500, 250, 200, 150, 100, or 60 total parts by weight, when the three necessary ingredients other than water in the composition are present in parts by weight as already specified above.

A method according to the present invention for treating the surface of tinned metal characteristically comprises contacting the surface of tinned metal with a surface treatment bath containing a surface treatment composition as defined above according to the present invention, then rinsing the treated surface with water, and subsequently drying the surface by heating. Independently, in a method according to the present invention, the bath preferably has a pH value of 6.0 or less, the total time of contacting the metal to be treated preferably is from 5 to 60 seconds, and the temperature during its contact with the tinned metal being treated preferably is from 35 to 65° C.

In this invention, phosphoric acid (i.e., $H_3PO_4$) and sodium phosphate (i.e., $Na_3PO_4$), for example, can be used to provide the phosphate ions for the water-based composition, but the system is not limited to the use of these materials; any other water soluble salt or acid salt of orthophosphoric acid that does not act adversely to the objects of the invention may be used, and any such salt is to be understood, for the purpose of the preferences indicated below, as contributing its full stoichiometric equivalent as orthophosphate ions to the concentration thereof in any composition according to the invention, irrespective of the actual degree of ionization that may prevail in the composition. This phosphate ions content is preferably within the range from 0.5 to 30 parts by weight, and most desirably within the range from 1 to 5 parts by weight, with respect to from 0.1 to 20 parts by weight of the water soluble polymers of formula (I). With a phosphate ions content of less than 0.5 parts by weight, the reactivity of the treatment liquid with the metal surface is low and a satisfactory film is not usually formed. Furthermore, although a good film is formed when the amount used exceeds 30 parts by weight, the cost of the treatment liquid is increased and this is disadvantageous economically.

Similarly, one or two or more types selected from among pyrophosphoric acid, tripolyphosphoric acid and tetrapolyphosphoric acid, and the salts of all of these acids, can be used to provide the condensed phosphate ions in a water-based composition of this invention, but the invention is not limited to the use of these materials. Any water soluble source of any phosphate anions that contain at least two atoms of phosphorus each may be used, and is to be understood for the purposes of the preferences below as supplying its full stoichiometric equivalent as condensed phosphate anions to the composition used according to the invention, irrespective of the actual degree of ionization that exists in the composition. For example, pyrophosphoric acid ($H_4P_2O_7$), sodium pyrophosphate ($Na_4P_2O_7$) and like compounds can be used to provide the pyrophosphate ions. The amount of condensed phosphate ions included preferably is from 0.1 to 10 parts by weight, and more preferably within the range from 0.5 to 3.0 parts by weight, with respect to from 0.1 to 20 parts by weight of the water soluble polymers of formula (I). With a condensed phosphate ions content of less than 0.1 part by weight, the etching action of the treatment liquid obtained on the metal surface is weak, and a sufficiently strong film can not usually be formed in an economically realistic time. On the other hand, if the amount of condensed phosphate ions included exceeds 10 parts by weight, the etching action apparently becomes too strong and the film forming reaction is impeded.

In formula (I), $X^1$ and $X^2$ each independently represents a hydrogen atom, a $C_1$ to $C_5$ alkyl group or a $C_1$ to $C_5$ hydroxyalkyl group. In those cases where the alkyl group or hydroxyalkyl group has six or more carbon atoms, the polymer obtained is bulky and steric hindrance arises, so that it is normally impossible to form a tight film which provides excellent corrosion resistance.

In formula (I), $Y^1$ and $Y^2$ each independently represents a hydrogen atom or a Z group which can be represented by the formulas already given. In formula (II) and formula (III), $R^1$, $R^2$, $R^3$, $R^4$ and $R^5$ each independently represents a hydrogen atom or one moiety selected from among the $C_1$ to $C_{10}$ alkyl moieties and the $C_1$ to $C_{10}$ hydroxyalkyl moieties. In those instances where an alkyl moiety or hydroxyalkyl moiety has eleven or more carbon atoms, a Z moiety which is obtained is too bulky, so that the film which is formed is coarse and its corrosion resistance is usually inadequate.

The average value of the substitution number of the aforementioned Z moieties on each aromatic ring in the aforementioned polymer molecule is from 0.2 to 1.0. For example, with a polymer in which n is 10 (which has twenty aromatic rings), the substitution number when there are ten Z moieties substituted is 10/20=0.5. With an average Z moiety substitution number of less than 0.2, the water solubility of the polymers is usually inadequate and the stability of the treatment liquid becomes poor. On the other hand, when the Z moiety substitution number exceeds 1.0, the water solubility of the polymer obtained usually is excessively high, so that a film can not be formed satisfactorily.

The amount of polymer of formula (I) included in a water-based composition of this invention is set within the range from 0.1 to 20 parts by weight as solids with respect to from 0.5 to 30 parts by weight of phosphate ions. This is because with less than 0.1 part by weight it is difficult to form a film in a stable manner on the metal surface while, if the amount included exceeds 20 parts by weight, the cost of the treatment liquid is high and this is a problem in economic terms.

The average degree of polymerization is from 2 to 50; if this value is less than 2, there is little or no improvement in corrosion resistance from the film which is obtained. Furthermore, if the average degree of polymerization exceeds 50, the stability of the water-based composition which is obtained is low, and this leads to problems in practical use.

In a process according to the invention, the pH of the surface treatment liquid which contains the aforementioned water-based composition for surface treatment purposes must be adjusted to 6.0 or below, because if it exceeds 6.0 a precipitate is liable to form, and the life of the liquid is therefore shortened. The pH is preferably in the range from 3.0 to 4.0. The pH of the treatment liquid can be adjusted using acids such as phosphoric acid, nitric acid and hydrochloric acid or alkalies such as sodium hydroxide, sodium carbonate and ammonium hydroxide. Moreover, hydrofluoric acid may be used as a pH adjusting agent in those instances where there is no problem with effluent treatment, such as where adequate pollution abatement treatment equipment already exists and can be operated at an economically acceptable cost.

Also, there are instances in which, when the tin ions that have been dissolved out from the metal surface mix with the treatment liquid, the polymer and tin form a complex and a precipitate is formed. In such a case, a tin chelating agent may advantageously be added to the treatment liquid. Ethylene diamine tetra-acetic acid, 1,2 cyclohexene diamine tetractic acid, triethanolamine, gluconic acid, heptogluconic acid, oxalic acid, tartaric acid, malic acid and organophosphonic acids, for example, can be used as tin chelating agents, but the agent used is not limited only to these materials.

Moreover, oxidizing agents may be included in the treatment liquid with a view to accelerating the coating forming reaction. No narrow limitation is imposed upon the type of oxidizing agent, and hydrogen peroxide, for example, can be used.

Also, there are instances when problems arise with foaming of the treatment liquid when a surface treatment liquid which contains a water-based composition for surface treatment purposes of this invention is being used for the spray treatment of tin-plated DI can surfaces. Whether or not foaming occurs is generally dependent to a great extent on the conditions of the apparatus, but in those instances where the operating conditions can not be modified to stop foaming, an anti-foaming agent may advantageously be added to the treatment liquid. No narrow limitation is imposed upon the anti-foaming agent, and any suitable agent which does not adversely affect adhesiveness of paint in any subsequent painting operation may be selected.

A polymer composition according to the present invention may contain a preservative or antimold agent. These function to inhibit putrefaction or mold growth when the surface treatment bath is used or stored at low temperatures. Hydrogen peroxide is a specific example in this regard.

In the preparation of a surface treatment liquid of this invention, first the phosphate ions source(s) and condensed phosphate ions source(s) are dissolved in a suitable amount in water in accordance with the aforementioned formulation, and the solution is stirred adequately. Next, the water soluble polymer of formula (I) is added to the solution and a surface treatment liquid according to the invention is obtained. Any of the optional ingredients noted above may be added subsequently.

The film which is formed by a surface treatment liquid of this invention is an organic-inorganic composite film which has phosphate(s) and polymer of formula (I) as the main components. The film formation process is hypothesized, without any intent to limit the invention, to occur as follows: Initially the tinned substrate is etched by the phosphate ions and condensed phosphate ions, so that a local rise in pH occurs at the interface between the treatment liquid and the metal surface, causing metal phosphate(s) to precipitate on the surface. The phenol moieties and amino moieties of the water soluble polymer which is used in the invention can have a chelating action, so that a type of coordination compound can be formed by the bonding of this material on the fresh substrate surface which has been formed by the etching. An organic-inorganic composite film is formed by these two simultaneous reactions (the precipitation of phosphate and the formation of coordination compounds). Polymer-metal coordination compound appears to be formed more easily when condensed phosphate ions are present in the reaction system and, as a result of this, it is possible to form an organic-inorganic composite film on the metal surface in a stable manner over a wide pH range.

Furthermore, it appears to be possible to polymerize further the polymer on the surface by heating the film which has been formed. Heating of the film is effective in instances when an especially high degree of corrosion resistance is required. Heating for a time of at least 1 minute at a temperature of about 200° C. is preferred for this purpose.

In a process according to this invention, the surface treatment liquid is preferably used in a process sequence such as that indicated below.

(1) Degreasing (generally with a weakly alkaline detergent)

(2) Water Rinse (3) Film Forming Treatment

Treatment Temperature: 35–65° C.

Treatment Method: Spray

Treatment Time: 5–60 seconds (4) Water Rinse (5) Rinsing with Deionized Water (6) Drying In the method of this invention the surface treatment liquid is preferably heated to a temperature of from 35 to 65° C. during use. The heated surface treatment liquid is brought into contact with the surface of the tin-plated DI can. The contact is preferably achieved by intermittent spraying, with each two consecutive periods of spraying separated by an interspraying time interval in which spraying is discontinued, because it has been found that a rise in pH in the vicinity of the interface between the metal surface and the treatment liquid is unlikely to continue to exist when the treatment liquid is being sprayed continuously, and under these conditions, the film does not form satisfactorily.

Because the interspraying time intervals are preferably only a few seconds long, and preferably no rinsing or other method of forcibly removing the previously applied aqueous liquid coat-forming composition from the substrate surface is utilized during these interspraying intervals, contact between the substrate surface and this surface treatment liquid normally continues during the interspraying intervals. Accordingly, the "total contact time" of the treatment liquid with the substrate surface in a process according to the invention is defined to include any intervals between beginning the first forced contact and ending the last forced contact between the substrate being treated and the treatment liquid, even when these first and last forced contacts are interrupted by intervals during which contact is not forced. This total contact time is preferably within the range from 5 to 60 seconds. With a total contact time of less than 5 seconds, the treatment liquid usually does not react adequately with the metal surface, so that a film which has excellent corrosion resistance is not formed. If the total contact time exceeds 60 seconds, there is generally no increase in protective value of the coating formed, and costs are higher.

The invention is illustrated in greater detail below through working examples, and its benefits may be further appreciated by contrast with the comparison examples. The individual surface treatment bath components and surface treatment methods are respectively described in the working and comparative examples.

EXAMPLES

Evaluation Methods (1) Corrosion Resistance

The corrosion resistance of the treated tin-plated DI cans was assessed by means of a red-rust test and the iron exposure value (hereinafter usually abbreviated as "IEV"). In the red-rust test, the treated tin-plated DI cans were immersed in hot tap water at 65° C. for 30 minutes and the extent of rust formation was evaluated by observation. The absence of rust was indicated by "++", partial rusting was indicated by "+" and full surface rusting was indicated by "X". Furthermore, corrosion of the tin-plated DI cans in many cases starts at the exposed iron parts produced in the DI process, so that the quality of covering by the film can be evaluated by measuring the exposed iron value The measurement of the IEV of the tin-plated DI cans was carried out in accordance with the method described in U.S. Pat. No. 4,332,646. In general, DI cans have a better corrosion resistance as the IEV value falls, and the corrosion resistance is generally good if the IEV value is less than 100.

(2) Paint Adhesion

Epoxy-urea based paint for cans was coated onto the surface of a treated can to a paint film thickness of from 5 to 7 $\mu$m and baked for 4 minutes at 215° C. Then the can was cut in the form of a strip measuring 5×150 mm and a sample was obtained by hot pressing a polyamide film onto this and peeling off the film using the 180° peel test method, and the paint adhesion was assessed by the peel strength at this time. Hence, the paint film adhesion was better as the peel strength increased. In general, the material is good if the peel strength is greater than 4.0 kilograms of force per 5 millimeters of width (hereinafter usually abbreviated as "kgf/5 mm").

(3) Mobility

The mobility of the cans was evaluated by measuring the static friction coefficient of the outer surface of the cans. Hence, better mobility is obtained with a lower static friction coefficient. In general, the mobility of the cans is adequate if the static friction coefficient is less than 1.0.

Example 1

Tin-plated DI cans which had been made from #25 tin plate were degreased by means of a 40 second spray treatment with a 1% aqueous solution of alkali based degreasing agent (named FINECLEANER® 4361A, manufactured by Nihon Parkerizing Co.) at 60° C. Then they were cleaned by rinsing with water, after which they were sprayed five times for a period of 2 seconds each with 5 second intervals, for a total contact time of 30 seconds, using Surface Treatment Liquid (1), with the composition indicated below, which had been heated to a temperature of 60° C. Next, they were rinsed with tap water and then sprayed for 10 seconds with deionized water which had a specific resistance value of at least 3,000,000 ohm·centimeters, and then they were dried for 2 minutes in a hot forced air drying oven at 180° C.

Surface Treatment Liquid (1)

75% Phosphoric acid (i.e., $H_3PO_4$): 10.0 g/L ($PO_4^{3-}$: 7.2 g/L)

Sodium pyrophosphate (i.e., $Na_4P_2O_7.10H_2O$): 3.0 g/L ($P_2O_7^{4-}$: 1.2 g/L)

Polymer (1)—solids part: 2.0 g/L pH 4.0 (Adjusted with sodium hydroxide)

Water Soluble Polymer (1) was according to formula (I) when: the average value of n=5; each of $X^1$ and $X^2$ represents a hydrogen atom; each of $Y^1$ and $Y^2$ represents a —$CH_2N(CH_3)_2$ group or hydrogen atom; and the average Z moiety substitution number=0.25.

Example 2

After cleaning of the tin-plated DI cans under the same conditions as described in Example 1, the cans were sprayed twice for 8.5 seconds each with a 3 second interval for at total contact time 20 seconds, using Surface Treatment Liquid (2) with the composition indicated below, which had been heated to a temperature of 60° C. After treatment, the DI cans were rinsed and dried under the same conditions as in Example 1.

Surface Treatment Liquid (2)

75% Phosphoric acid (i.e., $H_3PO_4$): 10.0 g/L ($PO_4^{3-}$: 7.2 g/L)

Sodium pyrophosphate (i.e., $Na_4P_2O_7.10H_2O$): 3.0 g/L ($P_2O_7^{4-}$: 1.2 g/L)

Polymer (1)—solids part: 0.4 g/L pH 3.0 (Adjusted with sodium carbonate)

The water soluble polymer was the same as that used in Example 1.

Example 3

After cleaning of tin-plated DI cans under the same conditions as described in Example 1, the cans were sprayed four times for 3 seconds each with 1 second intervals for a total contact time of 15 seconds, using Surface Treatment Liquid (3) with the composition indicated below, which had been heated to a temperature of 35° C. After treatment, the DI cans were rinsed and dried under the same conditions as in Example 1.

Surface Treatment Liquid (3)

75% Phosphoric acid (i.e., $H_3PO_4$): 20.0 g/L ($PO_4^{3-}$: 14.4 g/L)

Sodium pyrophosphate (i.e., $Na_4P_2O_7.10H_2O$) 6.0 g/L ($P_2O_7^{4-}$: 2.4 g/L)

Polymer (1)—solids part: 8.0 g/L pH 6.0 (Adjusted with sodium hydroxide)

The water soluble polymer was the same as that used in Example 1.

Example 4

After cleaning of tin-plated DI cans under the same conditions as described in Example 1, the cans were sprayed twice for 2 seconds each with a 2 second interval (total contact time 6 seconds) using Surface Treatment Liquid (4) with the composition indicated below, which had been heated to a temperature of 65° C. After treatment, the DI cans were rinsed and dried under the same conditions as in Example 1.

Surface Treatment Liquid (4)

75% Phosphoric acid (i.e., $H_3PO_4$): 1.5 g/L ($PO_4^{3-}$: 1.1 g/L)

Sodium pyrophosphate (i.e., $Na_4P_2O_7.10H_2O$): 5.0 g/L ($P_2O_7^{4-}$: 2.0 g/L)

Polymer (1)—solids part: 4.0 g/L pH 2.5 (Adjusted with nitric acid)

The water soluble polymer was the same as that used in Example 1.

Example 5

After cleaning of tin-plated DI cans under the same conditions as described in Example 1, the cans were sprayed four times for 4.5 seconds each with 4 second intervals for a total contact time of 30 seconds, using Surface Treatment Liquid (5) with the composition indicated below, which had been heated to a temperature of 60° C. After treatment, the DI cans were rinsed and dried under the same conditions as in Example 1.

Surface Treatment Liquid (5)

75% Phosphoric acid (i.e., $H_3PO_4$): 30.0 g/L ($PO_4^{3-}$: 21.6 g/L)

Sodium tripolyphosphate (i.e., $Na_5P_3O_{10}$): 1.2 g/L ($P_3O_{10}^{5-}$: 0.8 g/L)

Polymer (1)—solids part: 2.0 g/L pH 3.5 (Adjusted with sodium hydroxide)

The water soluble polymer was the same as that used in Example 1.

Example 6

After cleaning of tin-plated DI cans under the same conditions as described in Example 1, the cans were sprayed twice for 7.5 seconds each with a 5 second interval for a total contact time of 20 seconds, using Surface Treatment Liquid (6) with the composition indicated below, which had been heated to a temperature of 60° C. After treatment, the DI cans were rinsed and dried under the same conditions as in Example 1.

Surface Treatment Liquid (6)

75% Phosphoric acid (i.e., $H_3PO_4$): 10.0 g/L ($PO_4^{3-}$: 7.2 g/L)

Sodium pyrophosphate (i.e., $Na_4P_2O_7.10H_2O$): 3.0 g/L ($P_2O_7^{4-}$: 1.2 g/L)

Polymer (2)—solids part : 2.0 g/L pH 5.0 (Adjusted with sodium hydroxide)

Water Soluble Polymer (2) was a polymer according to formula (I) when: the average value of n=5; each of $X^1$ and $X^2$ represents a —$C_2H_5$ moiety; each of $Y^1$ and $Y^2$ represents a —$CH_2N(CH_2CH_2OH)_2$ moiety or a hydrogen atom; and the average Z moiety substitution number=1.0

Example 7

After cleaning of tin-plated DI cans under the same conditions as described in Example 1, the cans were sprayed five times for 2 seconds each with 5 second intervals for a total contact time of 30 seconds, using Surface Treatment Liquid (7) with the composition indicated below, which had been heated to a temperature of 60° C. After treatment, the DI cans were rinsed and dried under the same conditions as in Example 1.

Surface Treatment Liquid (7)

75% Phosphoric acid (i.e., $H_3PO_4$): 10.0 g/L ($PO_4^{3-}$: 7.2 g/L)

Sodium pyrophosphate (i.e., $Na_4P_2O_7.10H_2O$): 3.0 g/L ($P_2O_7^{4-}$: 1.2 g/L)

Polymer (3)—solids part: 2.0 g/L pH 4.0 (Adjusted with sodium hydroxide)

Water Soluble Polymer (3) was a polymer according to formula (I) when: is the average value of n=2; each of $X^1$ and $X^2$ represents a —$C_2H_5$ moiety; each of $Y^1$ and $Y^2$ represents a —$CH_2N(CH_2CH_2CH_2OH)_2$ moiety or hydrogen atom; and the average Z moiety substitution number 0.6.

Comparative Example 1

After cleaning of tin-plated DI cans under the same conditions as described in Example 1, the cans were sprayed five times for 2 seconds each with 5 second intervals for a total contact time of 30 seconds, using Surface Treatment Liquid (8) with the composition indicated below, which had been heated to a temperature of 60° C. After treatment, the DI cans were rinsed and dried under the same conditions as in the examples.

Surface Treatment Liquid (8)

75% Phosphoric acid (i.e., $H_3PO_4$): 10.0 g/L ($PO_4^{3-}$: 7.2 g/L)

Polymer (1)—solids part: 2.0 g/L pH 3.0 (Adjusted with sodium carbonate)

The water soluble polymer was the same as in Example 1.

Comparative Example 2

After cleaning of tin-plated DI cans under the same conditions as described in Example 1 they were sprayed continuously for 30 seconds with no interruption, using the Surface Treatment Liquid (9) of which the composition is indicated below and which had been heated to a temperature of 60° C. After treatment, the DI cans were rinsed and dried under the same conditions as in the examples.

Surface Treatment Liquid (9)

75% Phosphoric acid (i.e., $H_3PO_4$): 1.0 g/L ($PO_4^{3-}$: 0.72 g/L)

Polymer (1)—solids part: 2.0 g/L pH 7.0 (Adjusted with sodium hydroxide)

The water soluble polymer was the same as in Example 1.

Comparative Example 3

After cleaning of tin-plated DI cans under the same conditions as described in Example 1, the cans were sprayed twice for 1 second each with a 2 second interval for a total contact time of 4 seconds, using Surface Treatment Liquid (10) with the composition indicated below, which had been heated to a temperature of 60° C. After treatment, the DI cans were rinsed and dried under the same conditions as in the examples.

Surface Treatment Liquid (10)

75% Phosphoric acid (i.e., $H_3PO_4$): 10.0 g/L ($PO_4^{3-}$: 7.2 g/L)

Sodium pyrophosphate (i.e., $Na_4P_2O_7.10H_2O$): 1.0 g/L ($P_2O_7^{4-}$: 0.4 g/L)

Polymer (1)—solids part 0.05 g/L pH 4.0 (Adjusted with sodium carbonate)

The water soluble polymer was the same as in Example 1.

Comparative Example 4

After cleaning of tin-plated DI cans under the same conditions as described in Example 1, the cans were sprayed twice for 7.5 seconds each with a 5 second interval for a total contact time of 20 seconds, using Surface Treatment Liquid (11) with the composition indicated below, which had been heated to a temperature of 60° C.. After treatment, the DI cans were rinsed and dried under the same conditions as in the examples.

Surface Treatment Liquid (11)

95% Sulfuric acid ($H_2SO_4$) 2.0 g/L ($SO_4^{2-}$: 1.9 g/L)

Sodium pyrophosphate ($Na_4P_2O_7.10H_2O$) 1.0 g/L ($P_2O_7^{4-}$: 0.4 g/L)

Polymer (1)—solids part: 0.05 g/L pH 3.5 (Adjusted with sodium carbonate)

The water soluble polymer was the same as in Example 1.

Comparative Example 5

After cleaning of tin-plated DI cans under the same conditions as described in Example 1, the cans were sprayed continuously for 30 seconds using Surface Treatment Liquid (12) with the composition indicated below, which had been heated to a temperature of 60° C. After treatment, the DI cans were rinsed and dried under the same conditions as in the examples.

Surface Treatment Liquid (12)

75% Phosphoric acid (i.e., $H_3PO_4$): 1.0 g/L ($PO_4^{3-}$: 0.72 g/L)

Sodium pyrophosphate (i.e., $Na_4P_2O_7.10H_2O$) 1.0 g/L ($P_2O_7^{4-}$: 0.4 g/L)

Polymer (4)—solids part: 2.0 g/L pH 4.0 (Adjusted with sodium hydroxide)

Water Soluble Polymer (4) was a polymer according to formula (I) when: the average value of n=5; each of $X^1$ and $X^2$ represents a —$C_2H_5$ moiety; each of $Y^1$ and $Y^2$ represents a —$CH_2SO_3H$ moiety; and the average Z moiety substitution number=0.6.

Comparative Example 6

After cleaning of tin-plated DI cans under the same conditions as described in Example 1, the cans were sprayed five times for 2 seconds each with 5 second intervals for a total contact time of 30 seconds, using Surface Treatment Liquid (13) with the composition indicated below, which was a surface treatment liquid as taught in Japanese Patent Kokai H4-187782 and which had been heated to a temperature of 60° C. After treatment, the DI cans were rinsed and dried under the same conditions as in the examples.

Surface Treatment Liquid (13)

75% Phosphoric acid (i.e., $H_3PO_4$): 1.0 g/L ($PO_4^{3-}$: 0.72 g/L)

Sodium pyrophosphate (i.e., $Na_4P_2O_7.10H_2O$): 1.0 g/L ($PO_7^{4-}$: 0.4 g/L)

Polymer (5)—solids part: 2.0 g/L pH 4.0 (Adjusted with sodium hydroxide)

Water-Soluble Polymer 5 had the following formula (IV):

(IV)

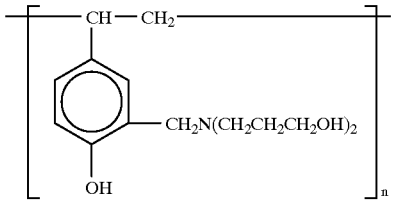

n = 20

Comparative Example 7

After cleaning of tin-plated DI cans under the same conditions as described in Example 1, the cans were sprayed three times for 8 seconds each with 3 second intervals for a total contact time of 30 seconds, using Surface Treatment Liquid (14) with the composition indicated below, which had been heated to a temperature of 60° C. After treatment, the DI cans were rinsed and dried under the same conditions as in the examples.

Surface Treatment Bath 14

75% Phosphoric acid (i.e., $H_3PO_4$): 1.0g/L ($PO_4^{-3}$: 0.72 g/L)

Sodium pyrophosphate (i.e., $Na_4P_2O_7.10H_2O$): 1.0 g/L ($P_2O_7^{-4}$: 0.4 g/L)

Polymer 6 (solids part): 2.0 g/L pH: 4.0 (adjusted with sodium hydroxide)

Water-Soluble Polymer 6, which is a resin described in Japanese Patent Kokai Number Hei 2-608, had the following formula (V):

(V)

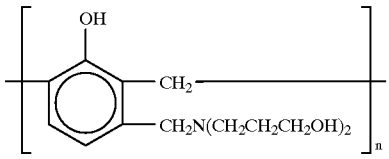

n = 10

Comparative Example 8

After cleaning of tin-plated DI cans under the same conditions as described in Example 1, the cans were sprayed five times for 2 seconds each with 5 second intervals for a total contact time of 30 seconds with a 3% aqueous solution of a commercial chemical coat-forming agent (named PAL- FOS® K3482A, manufactured by Nihon Parkerizing Co.), which had been heated to a temperature of 40° C. After treatment the cans were rinsed and dried under the same conditions as in Example 1.

The evaluation results for Examples 1 to 7 and Comparative Examples 1 to 8 are reported in Table 1 below.

As is clear from the results shown in Table 1, with the products obtained in Examples 1 to 7 where a water-based composition for surface treatment purposes and the method of surface treatment of this invention had been used, the corrosion resistance, adhesion properties and mobility were excellent. On the other hand, the products obtained in Comparative Example 1 (which contained no condensed phosphate ions), Comparative Example 2 (which contained no condensed phosphate ions and where the pH was higher than 6), Comparative Example 3 (where the total contact time was less than 5 seconds), Comparative Example 4 (which contained no phosphate ions but contained sulfate ions instead), Comparative Examples 5 to 7 (in which the water soluble polymer was different from those of formula (I) according to the invention) and Comparative Example 8 (which did not use a surface treatment liquid of this invention but another commercial chemical forming agent), where surface treatment liquids outside the scope of the invention were used, were unable to satisfy simultaneously the requirements of corrosion resistance, paint adhesion and mobility.

BENEFITS OF THE INVENTION

By using the water-based compositions and processes of this invention, excellent corrosion resistance of and paint adhesion to the surface of tinned substrates can be achieved, along with the excellent mobility which is required to achieve smooth conveyor transportation of tinned cans before painting or printing them. Also, the burden of effluent treatment can be reduced, because the surface treatment liquids of this invention are essentially chrome free and fluorine free.

TABLE 1

Results of the Evaluations

| Example or Comparison Example ("C Ex") Number | Corrosion Resistance: Red Rust Test | Corrosion Resistance: IEV | Peel Strength, kgf/5 mm | Coefficient of Static Friction |
|---|---|---|---|---|
| Example 1 | ++ | 15 | 4.0 | 0.7 |
| Example 2 | ++ | 15 | 4.0 | 0.7 |
| Example 3 | ++ | 15 | 4.0 | 0.7 |
| Example 4 | ++ | 15 | 4.0 | 0.7 |
| Example 5 | ++ | 15 | 4.0 | 0.7 |
| Example 6 | ++ | 15 | 4.0 | 0.7 |
| Example 7 | ++ | 15 | 4.0 | 0.7 |
| C Ex 1 | X | 100 | 2.0 | 1.0 |
| C Ex 2 | X | 500 | 1.5 | 1.2 |
| C Ex 3 | X | 500 | 2.0 | 1.2 |
| C Ex 4 | X | 500 | 1.5 | 1.2 |
| C Ex 5 | X | 500 | 1.5 | 1.2 |
| C Ex 6 | + | 50 | 2.0 | 1.0 |
| C Ex 7 | X | 500 | 1.5 | 1.2 |
| C Ex 8 | + | 50 | 4.0 | 1.2 |

The invention claimed is:

1. A process for treating a tinned metal surface in order to form on said surface a corrosion protective, paint adherent coating, said process comprising steps of:

(I) bringing the metal surface being treated into contact with an aqueous liquid coat-forming composition having a pH of not more than 6.0 and comprising water and:

(A) from 0.5 to 30 parts by weight of phosphate ions;

(B) from 0.1 to 10 parts by weight of condensed phosphate ions; and (C) from 0.1 to 20 parts by weight of water-soluble polymer molecules conforming to the following general formula (1):

(I)

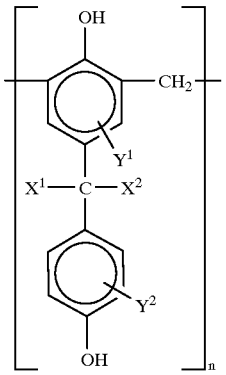

in which (i) each of $X^1$ and $X^2$, independently of each other and independently from one unit of the polymer, which is defined as a part of the polymer that conforms to formula (I) above except that the square brackets and the subscript n are omitted, to another unit of the polymer, represents a hydrogen atom, a $C_1$ to $C_5$ alkyl group, or a $C_1$ to $C_5$ hydroxyalkyl group; (ii) each of $Y^1$ and $Y^2$, independently of one another and independently from one unit of the polymer to another, represents a hydrogen atom or a moiety "Z" that conforms to one of the following formulas (II) and (III):

(II)

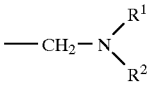

(III)

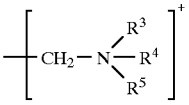

wherein each of $R^1$, $R^2$, $R^3$, $R^4$, and $R^5$, independently of each other and independently from one unit of the polymer to another, represents a $C_1$ to $C_{10}$ alkyl group or a $C_1$ to $C_{10}$ hydroxyalkyl group; (iii) the moiety Z bonded to any single phenyl ring in the polymer molecule may be identical to or may differ from the moiety Z bonded to any other phenyl ring in the polymer molecule; (iv) the average value over component (C) as a whole for the number of Z moieties substituted on each phenyl ring in the polymer molecule is from 0.2 to 1.0; and (v) n is a positive integer with an average value over component (C) as a whole from 2 to 50, so as to convert the metal surface contacted to a coated metal surface;

(II) separating the coated metal surface formed in step (I) from the aqueous liquid coat-forming composition with which it was contacted in step (I) and thereafter rinsing the coated metal surface with water to produce a rinsed coated metal surface; and (III) heating the rinsed coated metal surface sufficiently to dry said surface and form a dry coated metal surface.

2. A process according to claim 1, wherein: the contacting of step (I) is initiated by spraying the aqueous liquid coat-forming treatment composition onto the metal surface for a first spray period time; after the first spray period time, spraying of the aqueous liquid coat-forming treatment composition is discontinued for a first interspraying interval time; after the first interspraying interval time, spraying of the aqueous liquid coat-forming treatment composition is resumed for a second spray period time; and, optionally, the second spray period time is followed by at least one additional process step pair, each said process step pair consisting of an additional interspraying interval time followed by an additional spray period time; a sum formed by adding to one another the times of all spray periods and of all interspraying intervals being defined as "total contact time" for process step (I).

3. A process according to claim 2, wherein the total contact time for process step (I) is from 5 to 60 seconds, and the aqueous liquid coat-forming composition in step (I) has a pH value from 3.0 to 4.0.

4. A process according to claim 3, wherein the temperature of the aqueous liquid coat-forming composition in step (I) is maintained between 35 and 65° C. during all spray periods, and the aqueous liquid coat-forming composition in step (I) consists of 1000 total parts by weight.

5. A process according to claim 2, wherein the temperature of the aqueous liquid coat-forming composition in step (I) is maintained between 35 and 65° C. during all spray periods, and the aqueous liquid coat-forming composition in step (I) consists of 1000 total parts by weight.

6. A process according to claim 5, wherein during or after step (III), the metal surface and any coating thereon are heated to a temperature of at least 200° C. for a time of at least 1 minute.

7. A process according to claim 4, wherein during or after step (III), the metal surface and any coating thereon are heated to a temperature of at least 200° C. for a time of at least 1 minute.

8. A process according to claim 3, wherein during or after step (III), the metal surface and any coating thereon are heated to a temperature of at least 200° C. for a time of at least 1 minute.

9. A process according to claim 2, wherein during or after step (III), the metal surface and any coating thereon are heated to a temperature of at least 200° C. for a time of at least 1 minute.

10. A process according to claim 1, wherein during or after step (III), the metal surface and any coating thereon are heated to a temperature of at least 200° C. for a time of at least 1 minute.

11. A process according to claim 10, wherein, in the aqueous liquid coat-forming composition in step (I), components (A), (B), and (C) are present in amounts having a ratio by weight to one another within the range of {1 to 5 parts of phosphate ions}:{0.5 to 3 parts of condensed phosphate ions}:{0.1 to 20 parts, solids basis, of water soluble polymer conforming to formula (I)}.

12. A process according to claim 9, wherein, in the aqueous liquid coat-forming composition in step (I), components (A), (B), and (C) are present in amounts having a ratio by weight to one another within the range of {1 to 5 parts of phosphate ions}:{0.5 to 3 parts of condensed phosphate ions}:{0.1 to 20 parts, solids basis, of water soluble polymer conforming to formula (I)}.

13. A process according to claim 8, wherein, in the aqueous liquid coat-forming composition in step (I), components (A), (B), and (C) are present in amounts having a ratio by weight to one another within the range of {1 to 5 parts of phosphate ions}:{0.5 to 3 parts of condensed phosphate ions}:{0.1 to 20 parts, solids basis, of water soluble polymer conforming to formula (I)}.

14. A process according to claim 7, wherein, in the aqueous liquid coat-forming composition in step (I), components (A), (B), and (C) are present in amounts having a ratio by weight to one another within the range of {1 to 5 parts of phosphate ions}:{0.5 to 3 parts of condensed phosphate ions}:{0.1 to 20 parts, solids basis, of water soluble polymer conforming to formula (I)}.

15. A process according to claim 6, wherein, in the aqueous liquid coat-forming composition in step (I), components (A), (B), and (C) are present in amounts having a ratio by weight to one another within the range of {1 to 5 parts of phosphate ions}:{0.5 to 3 parts of condensed phosphate ions}:{0.1 to 20 parts, solids basis, of water soluble polymer conforming to formula (I)}.

16. A process according to claim 5, wherein, in the aqueous liquid coat-forming composition in step (I), components (A), (B), and (C) are present in amounts having a ratio by weight to one another within the range of {1 to 5 parts of phosphate ions}:{0.5 to 3 parts of condensed phosphate ions}:{0.1 to 20 parts, solids basis, of water soluble polymer conforming to formula (I)}.

17. A process according to claim 4, wherein, in the aqueous liquid coat-forming composition in step (I), components (A), (B), and (C) are present in amounts having a ratio by weight to one another within the range of {1 to 5 parts of phosphate ions}:{0.5 to 3 parts of condensed phosphate ions}:{0.1 to 20 parts, solids basis, of water soluble polymer conforming to formula (I)}.

18. A process according to claim 3, wherein, in the aqueous liquid coat-forming composition in step (I), components (A), (B), and (C) are present in amounts having a ratio by weight to one another within the range of {1 to 5 parts of phosphate ions}:{0.5 to 3 parts of condensed phosphate ions}:{0.1 to 20 parts, solids basis, of water soluble polymer conforming to formula (I)}.

19. A process according to claim 2, wherein, in the aqueous liquid coat-forming composition in step (I), components (A), (B), and (C) are present in amounts having a ratio by weight to one another within the range of {1 to 5 parts of phosphate ions}:{0.5 to 3 parts of condensed phosphate ions}:{0.1 to 20 parts, solids basis, of water soluble polymer conforming to formula (I)}.

20. A process according to claim 1, wherein, in the aqueous liquid coat-forming composition in step (I), components (A), (B), and (C) are present in amounts having a ratio by weight to one another within the range of {1 to 5 parts of phosphate ions}:{0.5 to 3 parts of condensed phosphate ions}:{0.1 to 20 parts, solids basis, of water soluble polymer conforming to formula (I)}.

* * * * *